US011592034B2

(12) United States Patent
Halbe et al.

(10) Patent No.: US 11,592,034 B2
(45) Date of Patent: Feb. 28, 2023

(54) VANELESS SUPERSONIC DIFFUSER FOR COMPRESSOR

(71) Applicant: Carrier Corporation, Palm Beach Gardens, FL (US)

(72) Inventors: Chaitanya Vishwajit Halbe, Manchester, CT (US); Michael M. Joly, Hebron, CT (US); William T. Cousins, Glastonbury, CT (US); Vishnu M. Sishtla, Mailus, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 22 days.

(21) Appl. No.: 17/254,333

(22) PCT Filed: Jun. 16, 2020

(86) PCT No.: PCT/US2020/037854

§ 371 (c)(1),
(2) Date: Dec. 21, 2020

(87) PCT Pub. No.: WO2020/263617

PCT Pub. Date: Dec. 30, 2020

(65) Prior Publication Data

US 2022/0049716 A1 Feb. 17, 2022

Related U.S. Application Data

(60) Provisional application No. 62/868,531, filed on Jun. 28, 2019.

(51) Int. Cl.
*F04D 29/44* (2006.01)
*F04D 29/28* (2006.01)
(Continued)

(52) U.S. Cl.
CPC ..... *F04D 29/441* (2013.01); *F04D 17/10* (2013.01); *F04D 21/00* (2013.01); *F04D 29/284* (2013.01)

(58) Field of Classification Search
CPC ..... F04D 17/10; F04D 21/00; F04D 29/284; F04D 29/441; F04D 17/025; F04D 17/06;
(Continued)

(56) References Cited

U.S. PATENT DOCUMENTS 2,898,031 A * 8/1959 Voigt ..... F04D 29/441 415/181
3,289,921 A * 12/1966 Soo ..... F04D 29/681 415/207
(Continued)

FOREIGN PATENT DOCUMENTS

| | | |
|---|---|---|
| FR | 935020 | 6/1948 |
| GB | 1115617 | 5/1968 |
| WO | 2013141912 | 9/2013 |

OTHER PUBLICATIONS

Machine Translation of FR 935,020, accessed Sep. 6, 2022 (Year: 2022).*

(Continued)

*Primary Examiner* — J. Todd Newton
(74) *Attorney, Agent, or Firm* — Carlson, Gaskey & Olds, P.C.

(57) ABSTRACT

A mixed-flow compressor includes an impeller attached to a shaft and rotatable about a shaft axis. A vaneless diffuser is located axially downstream of the impeller and has a converging portion and a diverging portion. A vaned diffuser is located axially downstream of the vaneless diffuser.

21 Claims, 3 Drawing Sheets

(51) Int. Cl.
*F04D 17/10* (2006.01)
*F04D 21/00* (2006.01)

(58) Field of Classification Search
CPC ..... F04D 29/442; F04D 29/444; F04D 23/00; F04D 29/403
USPC ..... 415/1
See application file for complete search history.

(56) References Cited

U.S. PATENT DOCUMENTS

| | | | | | |
|---|---|---|---|---|---|
| 3,625,630 | A * | 12/1971 | Soo | F04D 29/541 | 415/199.5 |
| 3,658,437 | A * | 4/1972 | Soo | F04D 29/444 | 415/181 |
| 3,941,501 | A * | 3/1976 | Shank | F04D 29/442 | 415/143 |
| 4,696,622 | A * | 9/1987 | Traczyk | F04D 21/00 | 415/181 |
| 5,123,811 | A * | 6/1992 | Kuroiwa | F04D 29/162 | 415/207 |
| 6,712,588 | B1 | 3/2004 | Ribaud | | |
| 10,527,059 | B2 * | 1/2020 | Musgrave | F04D 17/10 | |
| 2009/0060731 | A1 * | 3/2009 | Chen | F04D 29/441 | 415/204 |
| 2013/0149100 | A1 | 6/2013 | Lawlor et al. | | |
| 2019/0285085 | A1 * | 9/2019 | Cousins | F04D 29/284 | |
| 2020/0063753 | A1 * | 2/2020 | Higashimori | F04D 29/441 | |
| 2021/0123444 | A1 * | 4/2021 | Joly | F04D 17/06 | |

OTHER PUBLICATIONS

International Search Report and Written Opinion for International Application No. PCT/US2020/037854 dated Sep. 25, 2020.

* cited by examiner

VANELESS SUPERSONIC DIFFUSER FOR COMPRESSOR

CROSS-REFERENCE TO RELATED APPLICATIONS

This application claims priority to U.S. Provisional Application No. 62/868,531, which was filed on Jun. 28, 2019 and is incorporated herein by reference.

BACKGROUND

The disclosure herein relates generally to an example mixed-flow compressor, and more particularly, to a diffuser structure for use in a mixed-flow compressor of a refrigeration system.

Existing mixed-flow compressors typically include a power driven impeller through which an inflow of refrigerant is induced that is turned radially outward and then back to axial flow into a diffuser. A diffuser of the compressor commonly includes an annular passage defined by a wall surface of a fixed plate radially spaced from a shaped wall surface of a shroud, and a set of vanes. The diffuser has an inlet end receiving the impeller outflow and an outlet end from which refrigerant is provided to a compressor volute that is circumferentially divergent for example. Kinetic energy is converted by the diffuser of the compressor into a static pressure rise within the diffuser.

SUMMARY

In one exemplary embodiment, a mixed-flow compressor includes an impeller attached to a shaft and rotatable about a shaft axis. A vaneless diffuser is located axially downstream of the impeller and has a converging portion and a diverging portion. A vaned diffuser is located axially downstream of the vaneless diffuser.

In a further embodiment of the above, the converging portion is located axially upstream of the diverging portion.

In a further embodiment of any of the above, the converging portion is connected to the diverging portion with an axially extending mid-portion having a constant cross-sectional area.

In a further embodiment of any of the above, the vaneless diffuser includes an inner wall and an outer wall defining a fluid flow path there between.

In a further embodiment of any of the above, at least one of the inner wall and the outer wall are rotatable relative to the shaft axis.

In a further embodiment of any of the above, both the inner wall and the outer wall are rotatable about the shaft axis.

In a further embodiment of any of the above, the inner wall is supported on at least one inner wall bearings and the outer wall is supported on at least one outer wall bearings.

In a further embodiment of any of the above, the vaned diffuser includes a plurality of vanes circumferentially spaced from each other around the shaft axis.

In a further embodiment of any of the above, the converging portion extends up to 75% of an axial length of the vaneless diffuser.

In a further embodiment of any of the above, the converging portion includes up to a 50% reduction in cross-sectional area between an inlet to the converging portion and an outlet of the converging portion.

In a further embodiment of any of the above, the diverging portion extends up to 75% of an axial length of the vaneless diffuser.

In a further embodiment of any of the above, the diverging portion includes up to a 50% increase in cross-sectional area between an inlet to the diverging portion and an outlet of the diverging portion.

In another exemplary embodiment, a method of operating a mixed-flow compressor includes the steps of compressing a fluid with an impeller driven by a motor section through a shaft and rotatable about a shaft axis. The fluid is diffused at an outlet of the impeller in a vaneless diffuser that has a converging portion and a diverging portion. The fluid is diffused in a vaned diffuser axially downstream of the vaneless diffuser.

In a further embodiment of any of the above, the vaneless diffuser reduces a Mach number of the fluid entering the vaneless diffuser from a value greater than one at an inlet to the vaneless diffuser to a value less than one at an outlet of the vaneless diffuser.

In a further embodiment of any of the above, the vaneless diffuser includes an inner wall and an outer wall that define a fluid flow path there between. At least one of the inner wall and the outer wall are rotatable about the shaft axis.

In a further embodiment of any of the above, at least one of the inner wall and the outer wall is driven by engagement of the fluid flowing over either the inner wall or the outer wall.

In a further embodiment of any of the above, both the inner wall and the outer wall are rotatable about the shaft axis and driven by the fluid flowing over the inner wall and the outer wall.

In a further embodiment of any of the above, a shock train is directed axially downstream through the vaneless diffuser and away from the impeller.

In a further embodiment of any of the above, the converging portion reduces a supersonic speed of the fluid through a series of oblique shocks. The diverging portion reduces a subsonic speed of the fluid and reduces flow separation at walls of the diverging portion.

In a further embodiment of any of the above, the diverging portion extends up to 50% of an axial length of the vaneless diffuser to prevent transonic or supersonic flow over the vaned diffuser.

DETAILED DESCRIPTION

Figure 1:
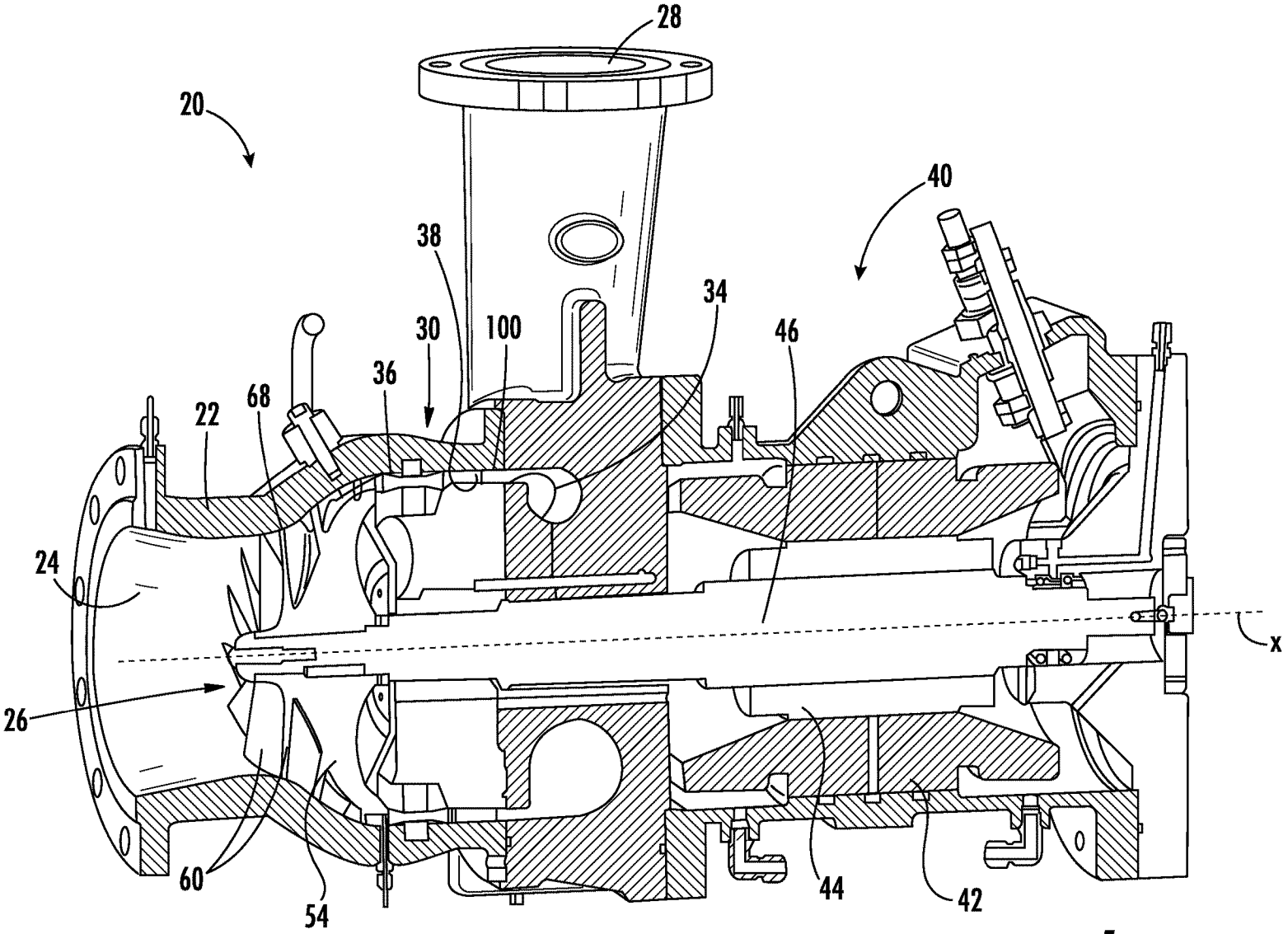
FIG. 1 is a perspective cross-sectional view of a mixed flow compressor according to a non-limiting example.

Mixed-flow compressors are used in a number of applications, such as in a refrigeration system to move a refrigerant through a refrigeration circuit. FIG. 1 illustrates an example "mixed flow" compressor 20 used to compress and transfer refrigerant vapor in the refrigeration system. In order to transfer and compress refrigerant, the compressor 20 is capable of operating with refrigerants at a low or medium pressure.

In the illustrated example shown in FIG. 1, the compressor 20 includes a main casing or housing 22 that at least partially defines an inlet 24 into the compressor 20 for receiving the refrigerant and an outlet 28 for discharging the refrigerant from the compressor 20. The compressor 20 draws the refrigerant towards the inlet 24 by rotating a mixed flow impeller 26 immediately downstream of the inlet 24. The impeller 26 then directs the refrigerant to a diffuser section 30 located axially downstream of the impeller 26. The diffuser section 30 includes a vaneless portion 36 and a vaned portion 38 located axially downstream of the vaneless portion 36. From the diffuser section 30, the refrigerant travels in an axial direction downstream and enters a volute 34 before being redirected from the axial direction to a radial direction outward toward the outlet 28 of the compressor 20.

The compressor 20 also includes a motor section 40 for driving the impeller 26. In the illustrated example, the motor section 40 includes a stator 42 attached to a portion of the housing 22 that surrounds a rotor 44 attached to an impeller drive shaft 46. The impeller drive shaft 46 is configured to rotate about an axis X. The axis X of rotation is common with the impeller 26, the diffuser section 30, the rotor 44, and the impeller drive shaft 46 and is common with a central longitudinal axis extending through the housing 22. In this disclosure, axial or axially and radial or radially is in relation to the axis X unless stated otherwise.

Figure 2A:
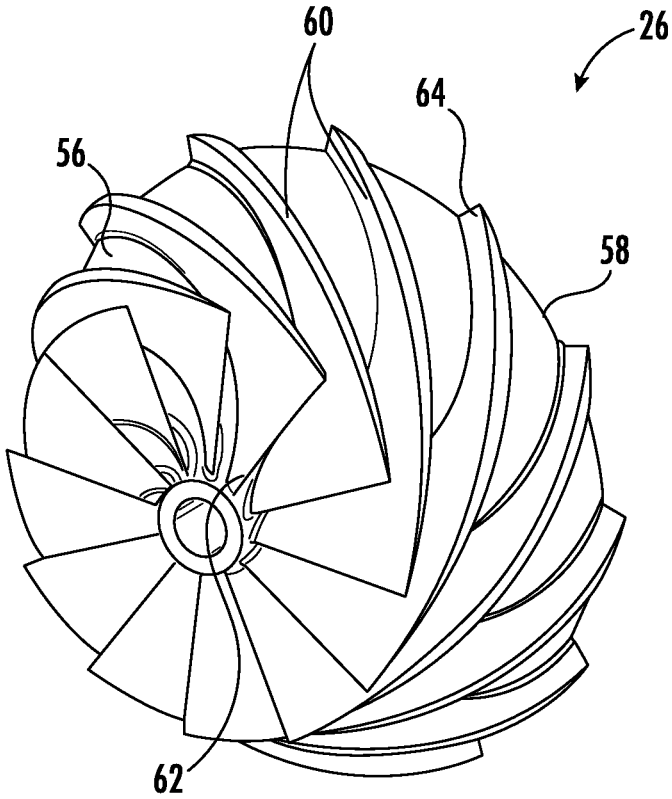
FIG. 2A is front perspective view of an impeller of the mixed flow compressor of FIG. 1.
Figure 2B:
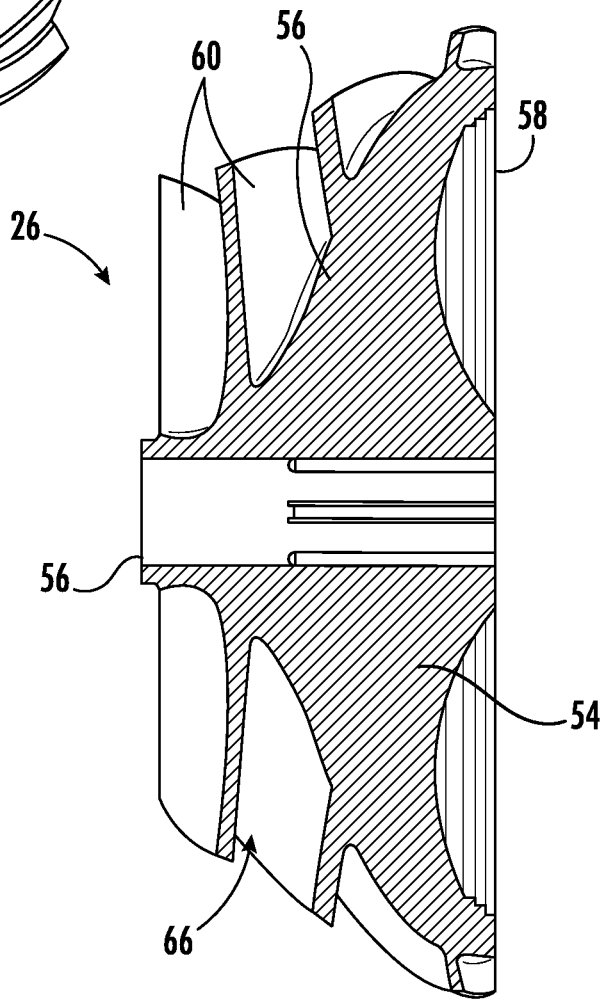
FIG. 2B is a cross-sectional view of the impeller of FIG. 2A.

As shown in FIGS. 2A and 2B, the impeller 26 includes a hub or body 54 having a front side 56 and back side 58. As shown, the diameter of the front side 56 of the body 54 generally increases toward the back side 58, such that the impeller 26 is generally conical in shape. A plurality of blades 60 extend radially outward from the body 54 relative to the axis X. Each of the plurality of blades 60 is arranged at an angle to the axis of rotation X of the drive shaft 46. In one example, each of the blades 60 extends between the front side 56 and the back side 58 of the impeller 26. As shown, each of the blades 60 includes an upstream end 62 adjacent the front side 56 and a downstream end 64 adjacent the back side 58. Further, the downstream end 64 of the blade 60 is circumferentially offset from the corresponding upstream end 62 of the blade 60.

A plurality of passages 66 is defined between adjacent blades 60 to discharge a fluid passing over the impeller 26 generally parallel to the axis X. As the impeller 26 rotates, fluid approaches the front side 56 of the impeller 26 in a substantially axial direction and flows through the passages 66 defined between adjacent blades 60. Because the passages 66 have both an axial and radial component, the axial flow provided to the front side 56 of the impeller 26 simultaneously moves both parallel to and circumferentially about the axis X of the drive shaft 46. In combination, an inner surface 68 (shown in FIG. 1) of the housing 22 and the passages 66 of the impeller 26 cooperate to discharge the compressed refrigerant fluid from the impeller 26. In one example, the compressed fluid is discharged from the impeller 26 at an angle relative to the axis X of the drive shaft 46 into the adjacent diffuser section 30.

Figure 3:
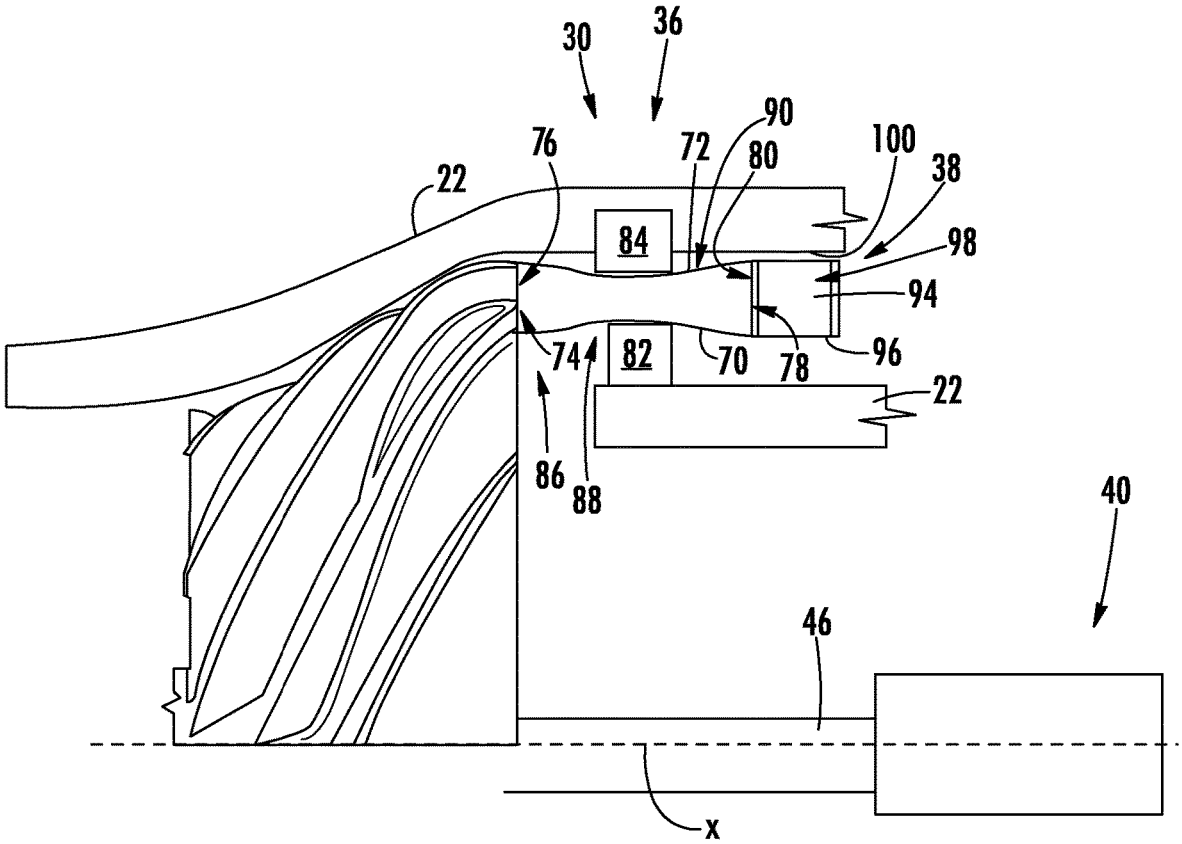
FIG. 3 schematically illustrates an example diffuser located axially downstream of the impeller.
Figure 4:
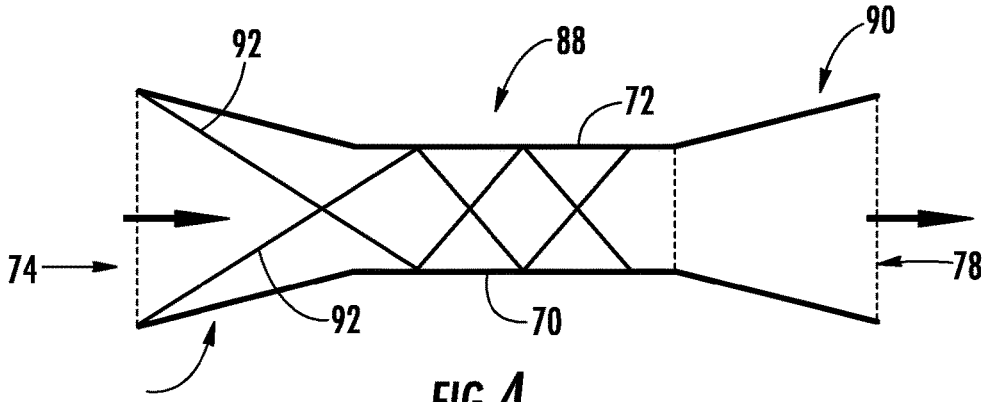
FIG. 4 schematically illustrates an example vaneless portion of the diffuser.

FIG. 3 schematically illustrates the impeller 26 positioned relative to the diffuser section 30. In the illustrated example, the vaneless portion 36 includes radially inner wall 70 and a radially outer wall 72 that each form a continuous loop surrounding the axis X. The radially inner and outer walls 70, 72 define an inlet 74 adjacent an outlet 76 of the impeller 26 and an outlet 78 adjacent an inlet 80 to the vaned portion 38. In the illustrated example, a radial dimension between the inner wall 70 and the outer wall 72 at the inlet 74 is approximately equal to a radial dimension between the inner surface 68 on the housing 22 and the body front side 56 of the impeller 26 at the outlet 76.

The radially inner wall 70 and the radially outer wall 72 are supported on bearing assemblies 82 and 84, respectively. Although only a single bearing assembly 82, 84 are schematically illustrated, more than one bearing assembly could be located along each of the inner wall 70 and the outer wall 72. In the illustrated example, the bearing assembly 82 includes an inner race that is supported on a radially inner side by a static structure, such as a portion of the housing 22, and an outer race on a radially outer side that engages the inner wall 70. Alternatively, the inner race on the bearing assembly 82 could engage a rotating structure, such as a structure that rotates with the drive shaft 46. The bearing assembly 84 includes an inner race on a radially inner side of the bearing assembly 84 that engages the outer wall 72 and an outer race on a radially outer side of the bearing assembly 84 that engages a portion of the housing 22 or a static structure fixed relative to the housing 22.

The bearing assemblies 82, 84 allow the inner wall 70 and the outer wall 72 to rotate independently of each other as well as being able to rotate independently of the impeller 26 and the drive shaft 46. During operation of the compressor 20, the inner wall 70 and the outer wall 72 are driven by the frictional forces of the refrigerant traveling over the inner wall 70 and the outer wall 72. One feature of allowing the inner wall 70 and the outer wall 72 to rotate freely and be driven by the friction forces of the refrigerant is a reduction in end-wall losses. End wall losses result from a refrigerant traveling over a surface with a large variation in relative speed between the refrigerant and the surface.

Although the illustrated example illustrates both the inner wall 70 and the outer wall 72 as being able to rotate freely on bearing assemblies 82, 84, respectively, one of the inner wall 70 or the outer wall 72 could be fixed from rotating relative to the housing 22. Alternatively, the bearing assemblies 82, 84 could be selectively lockable depending on the operating condition of the compressor 20.

The inner and outer wall 70, 72 also include varying radial dimensions to create a converging portion 86, a mid-portion 88, and a diverging portion 90 in the vaneless portion 36 of the diffuser section 30. In the converging portion 86, both the inner wall 70 and the outer wall 72 converge towards each other such that a cross-section area of the converging portion 86 decreases in an axially downstream direction. In the mid-portion 88, both the inner wall 70 and outer wall 72 include a constant radial dimension such that a cross-sectional area of the mid-portion 88 is constant between converging portion 86 and the diverging portion 90. In the diverging portion 90, both the inner wall 70 and the outer wall 72 move away from each other such that a cross-sectional area of the diverging portion 90 increase in an axially downstream direction. The diverging portion 90 reduces a subsonic speed of the fluid and reduces flow separation at the inner and outer walls 70, 72.

Alternatively, the mid-portion 88 located immediately downstream of the converging portion 86 could converge at a smaller rate than the converging portion 86 to provide a transition from the converging portion 86 to the mid-portion 88. Additionally, the mid-portion 88 located immediately upstream of the diverging portion 90 could diverge at a smaller rate that the diverging portion 90 to provide a transition between the mid-portion 88 and the diverging portion 90.

One feature of the vaneless portion 36 is to reduce a Mach number of the refrigerant exiting the impeller 26 and entering the vaneless portion 36 of the diffuser section 30. In particular, the vaneless portion 36 reduces the Mach number of the refrigerant from greater than one entering the converging portion 86, to approximately one in the mid-portion 88, to less than one in the diverging portion 90. The reduction in Mach number increases the pressure of the refrigerant and decreases the speed of the refrigerant to reduce losses once the refrigerant is turned by the vaned portion 38.

Another feature of the vaneless portion 36 is the containment of oblique shock trains 92 within the vaneless portion 36. The containment of the oblique shock trains 92 within the vaneless portion 36 reduces or eliminates interaction of oblique shocks with the impeller 26 to increase performance of the impeller 26 and overall performance of the compressor 20 as well. Additionally, the series of oblique shocks also reduces a supersonic speed of the fluid in the converging portion 86.

As mentioned above, one features of the vaned portion 38 located axially downstream of the vaneless portion 36 is to turn the flow of refrigerant and in particular to turn the flow of refrigerant closer to an axial direction. The vaned portion 38 can turn the direction of the refrigerant entering with a plurality of circumferentially spaced vanes 94 (FIG. 3) without significant losses in energy due to the reduction in the speed of the refrigerant after it has exited the vaneless portion 36. In the illustrated example, the vanes 94 are fixed relative to the housing 22 and extend radially outward from an inner ring 96 such that fluid passage 98 are formed between the inner ring 96, the vanes 94, and an inner surface 100 of the housing 22.

Although the different non-limiting examples are illustrated as having specific components, the examples of this disclosure are not limited to those particular combinations. It is possible to use some of the components or features from any of the non-limiting examples in combination with features or components from any of the other non-limiting examples.

It should be understood that like reference numerals identify corresponding or similar elements throughout the several drawings. It should also be understood that although a particular component arrangement is disclosed and illustrated in these exemplary examples, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claim should be studied to determine the true scope and content of this disclosure.

What is claimed is:

1. A mixed-flow compressor comprising:

an impeller attached to a shaft and rotatable about a shaft axis;

a vaneless diffuser located axially downstream of the impeller, the vaneless diffuser having a converging portion and a diverging portion; and a vaned diffuser located axially downstream of the vaneless diffuser.

2. The mixed-flow compressor of claim 1, wherein the converging portion is located axially upstream of the diverging portion.

3. The mixed-flow compressor of claim 2, wherein the converging portion is connected to the diverging portion with an axially extending mid-portion having a constant cross-sectional area.

4. The mixed-flow compressor of claim 1, wherein the vaneless diffuser includes an inner wall and an outer wall defining a fluid flow path there between.

5. The mixed-flow compressor of claim 4, wherein at least one of the inner wall and the outer wall are rotatable relative to the shaft axis.

6. The mixed-flow compressor of claim 4, wherein both the inner wall and the outer wall are rotatable about the shaft axis.

7. The mixed-flow compressor of claim 6, wherein the inner wall is supported on at least one inner wall bearing located radially inward from the inner wall and the outer wall is supported on at least one outer wall bearing located radially outward of the outer wall and the at least one inner wall bearing and the at least one outer wall bearing allow the inner wall to rotate independently of the outer wall.

8. The mixed-flow compressor of claim 7, wherein the vaned diffuser includes a plurality of vanes circumferentially spaced from each other around the shaft axis and the plurality of vanes are fixed from rotating relative to a housing for the mixed-flow compressor.

9. The mixed-flow compressor of claim 1, wherein the converging portion extends less than or equal to 75% of an axial length of the vaneless diffuser.

10. The mixed-flow compressor of claim 9, wherein the converging portion includes less than or equal to a 50% reduction in cross-sectional area between an inlet to the converging portion and an outlet of the converging portion.

11. The mixed-flow compressor of claim 1, wherein the diverging portion extends less than or equal to 75% of an axial length of the vaneless diffuser.

12. The mixed-flow compressor of claim 11, wherein the diverging portion includes less than or equal to a 50% increase in cross-sectional area between an inlet to the diverging portion and an outlet of the diverging portion.

13. A method of operating a mixed-flow compressor comprising the steps of:

compressing a fluid with an impeller driven by a motor section through a shaft and rotatable about a shaft axis;

diffusing the fluid at an outlet of the impeller in a vaneless diffuser having a converging portion and a diverging portion; and diffusing the fluid in a vaned diffuser axially downstream of the vaneless diffuser.

14. The method of claim 13, wherein the vaneless diffuser reduces a Mach number of the fluid entering the vaneless diffuser from a value greater than one at an inlet to the vaneless diffuser to a value less than one at an outlet of the vaneless diffuser.

15. The method of claim 13, wherein the vaneless diffuser includes an inner wall and an outer wall defining a fluid flow path there between and at least one of the inner wall and the outer wall is rotatable about the shaft axis.

16. The method of claim 15, wherein at least one of the inner wall and the outer wall is driven by engagement of the fluid flowing over either the inner wall or the outer wall.

17. The method of claim 15, wherein both the inner wall and the outer wall are rotatable about the shaft axis and driven by the fluid flowing over the inner wall and the outer wall.

18. The method of claim 15, including directing a shock train axially downstream through the vaneless diffuser and away from the impeller.

19. The method of claim 13, wherein the converging portion reduces a supersonic speed of the fluid through a series of oblique shocks and the diverging portion reduces a subsonic speed of the fluid and reduces flow separation at walls of the diverging portion.

20. The method of claim 13, wherein the diverging portion extends less than or equal to 50% of an axial length of the vaneless diffuser to prevent transonic or supersonic flow over the vaned diffuser.

21. The method of claim 13, wherein the vaneless diffuser includes an inner wall and an outer wall defining a fluid flow path there between, the inner wall is supported by at least one inner wall bearing and the outer wall is supported by at least one outer wall bearing to located radially outward of the at least one inner wall bearing to allow the inner wall to rotate independently of the inner wall about the shaft axis, and the vaned diffuser includes a plurality of vanes circumferentially spaced from each other around the shaft axis and the plurality of vanes are fixed from rotating relative to a housing for the mixed-flow compressor.

* * * * *